United States Patent [19]

Tracy et al.

[11] Patent Number: 4,853,275

[45] Date of Patent: Aug. 1, 1989

[54] CUSHIONED STRAP

[75] Inventors: Charles R. Tracy, Greensboro, N.C.; Robert S. Elliott, Parsippany, N.J.

[73] Assignee: J. P. Stevens & Co., Inc., New York, N.Y.

[21] Appl. No.: 924,194

[22] Filed: Oct. 27, 1986

[51] Int. Cl.[4] ..... B32B 1/00

[52] U.S. Cl. ..... 428/178; 428/253; 428/293; 428/294

[58] Field of Search ..... 428/232, 233, 294, 36, 428/253, 212, 213, 156, 171, 175, 178, 293

[56] References Cited

U.S. PATENT DOCUMENTS 4,130,679 12/1978 Breznak et al. ..... 428/233
4,500,578 2/1985 Van de Camp ..... 428/178

*Primary Examiner*—James J. Bell
*Attorney, Agent, or Firm*—Amster, Rothstein & Ebenstein

[57] ABSTRACT

Cushioned strap including a continuously woven or knitted fabric having two flat portions separated by a tubular portion, and a plurality of length of yarn positioned in the tubular portion and extending substantially freely through the tubular portion between the end portions thereof. The cushioned strap provides good appearance and comfort and can be manufactured economically.

26 Claims, 4 Drawing Sheets

CUSHIONED STRAP

The invention relates to a strap such as a shoulder strap, and particularly to a cushioned strap which can be used as a support strap, handle or gripping means or in any other application where cushioning is desired and to a method of manufacturing the same.

Support straps are widely used for many different types of articles such as brassieres, lingerie, backpacks, straps for scuba diving equipment, medical slings, luggage, pocketbooks, and the like. It is a common practice in the industry to produce a support strap separately and later incorporate the support strap into the production of the article.

When a strap forms a part of a consumer article, it is desirable for the strap to provide comfort to the user as well as to have a good physical appearance. The manufacturer of support straps is also concerned with the economics of producing a shoulder strap and accordingly must balance the production costs against the appearance and comfort of the support straps to the consumer. Often, the comfort of the strap is sacrificed to reduce production costs.

Cushioned support straps used for shoulder straps are of particular interest herein. Shoulder straps vary in size depending on the article. In addition, the physical appearance of the shoulder strap depends on its use. Shoulder straps for brassieres, lingerie and the like must have excellent physical appearance such as being smooth and having small maximum cross sections as well as providing good comfort.

The prior art discloses many different embodiments of support straps which use tubular fabrics. For example, U.S. Pat. No. 2,615,172 discloses a padded shoulder strap for use with a brassiere or the like. The strap uses resilient padding such as foam rubber within a tubular fabric to provide cushioning on the portion of the strap which goes over a shoulder. The fabric is sewn together around the padding to produce the tubular fabric enclosing the foam rubber. This article required separate production steps and operations.

Likewise, U.S. Pat. No. 4,575,874 discloses a pad for use on a shoulder strap. Such pad is fastened around the shoulder strap and held in place by fabric closure material along the marginal edges of the top and bottom of the cushion.

U.S. Pat. No. 4,550,869 discloses a longitudinally elastic cushioned strap which includes discrete pads formed from elastic pads or blocks stitched in a tube. The longitudinal elasticity is provided by the construction of accordian-like pleats in an otherwise inelastic strap.

U.S. Pat. No. 4,105,641 discloses a flattened woven tubular fabric having monofilament filling yarns in both layers of the fabric with the monofilament filling yarns woven alternately and intermittently with warp yarns to connect the two layers together so that the resulting fabric has an oval cross-sectional appearance. The extent of cushioning is inherently limited for this article because the filling yarn is not densely packed and is not a soft yarn.

It is an object of the present invention to provide a cushioned support strap which has a good physical appearance, is comfortable to use, and can be manufactured economically.

It is a further object of the present invention to provide a method of manufacturing the cushioned support strap.

It is a still further object of the invention to provide a cushioned support strap suitable for use with brassieres, lingerie, and the like.

In accordance with one embodiment demonstrating objects and features of the present invention, there is provided a cushioned support strap comprising a continuously woven or knitted fabric having two flat portions separated by a tubular portion; and a plurality of lengths of yarn positioned in the tubular portion and extending substantially freely through the tubular portion between the end portions thereof. Preferably, the lengths of yarn are longer than the tubular portion when the strap is in its relaxed state although the yarn may be of substantially the same length as the tubular portion.

In another embodiment, the invention relates to a cushioned support strap comprising a continuously woven or knitted fabric having two flat portions separated by a tubular portion; a plurality of lengths of elastic yarn positioned in the tubular portion and extending substantially freely through the tubular portion between the end portions thereof; and binding means near the end portions of the tubular portion for binding the ends of the lengths of yarn to the tubular portion, the lengths of yarn being shorter than the tubular portion when the strap is in its relaxed state.

The invention also relates to articles of manufacture for producing cushioned support straps. One article of manufacture comprises a continuously woven or knitted fabric having alternating flat and tubular portions, and a plurality of elastic lengths of yarn positioned in each of the tubular portions and extending substantially freely through each of the tubular portions between the end portions thereof.

Another article of manufacture comprises a continuously woven or knitted fabric having alternating flat and tubular portions; a plurality of elastic lengths of yarn positioned in each of the tubular portions extending substantially freely through each of the tubular portions between opposite portions thereof; and binding means near the end portions of each tubular portion for binding the ends of the lengths of yarn to the respective tubular portion, the lengths of yarn in the respective tubular portion being shorter than the corresponding tubular portion when the article is in its relaxed state.

Additionally, the present invention relates to a method of manufacturing cushioned support straps using a weaving or knitting machine capable of continuously fabricating alternate flat and tubular portions, comprising the steps of:

(a) positioning a plurality of lengths of yarn near and substantially parallel to the longitudinal direction of the straps being fabricated;

(b) subsequently, fabricating a flat portion;

(c) thereafter, fabricating a tubular portion which encloses a portion of each of the lengths of yarn extending between the end portions of the tubular portion; and (d) thereafter, fabricating another flat portion.

The method of manufacture may also include the steps of binding the ends of the yarn at each end of the tubular portion and removing the portions of the yarn outside the tubular portions.

The above brief description as well as further objects and features of the invention will become more apparent by reference to the following detailed descriptions of the presently preferred, illustrative embodiments of the present invention taken in conjunction with the accompanying drawings in which.

Figure 1:
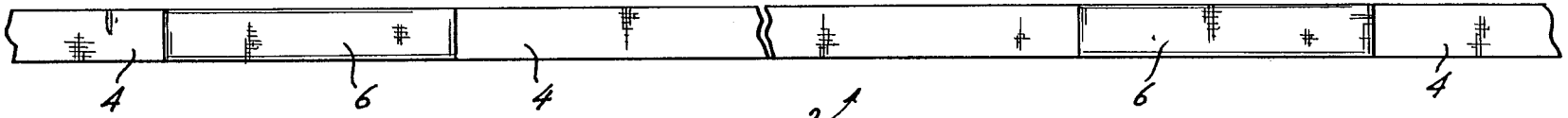
FIG. 1 is a plan view of one embodiment of a manufactured article of strapping which can be cut into individual cushioned support straps in accordance with the present invention.

Several embodiments of the invention will be described herein with reference to the drawings. FIG. 1 shows a plan view of one embodiment of an article of strapping made in accordance with the invention. The strapping generally designated by the reference numeral 2 includes alternating flat portions 4 and tubular portions 6. The respective flat portions 4 and tubular portions 6 can be of any desired length so that when the strapping is cut into individual cushioned support straps, each cushioned support strap includes a cushioned tubular portion 6 bounded by flat portions 4, 4.

As discussed more fully below, during manufacture in accordance with the method of the present invention, strapping 2 is knitted or woven in alternating sections of flat and tubular construction. During construction, the tubular portion 6 is knitted or woven around a plurality of yarns 8. In the preferred embodiment, the strapping is knitted or woven from elastomeric yarn in a construction that allows the flat and tubular portions of the strapping to be extensible in the longitudinal direction and to be substantially stable across the width of both the flat and tubular portions.

Preferably, the yarns 8 are lengths of yarn made into thicker or denser cords by a relatively simple and inexpensive means of construction such as braiding. As used herein, the term "yarn" refers to at least one fiber and can be a plurality of fibers woven, non-woven, braided, twisted together or otherwise constructed to provide the necessary cushioning effect. The particular yarn used for the cords 8 is also selected with cost in mind because many inexpensive materials are suitable. It has been found that polyester yarn is particularly suited for the braided cords. In the preferred embodiment, the braided cords 8 are relatively inelastic.

Figure 2:
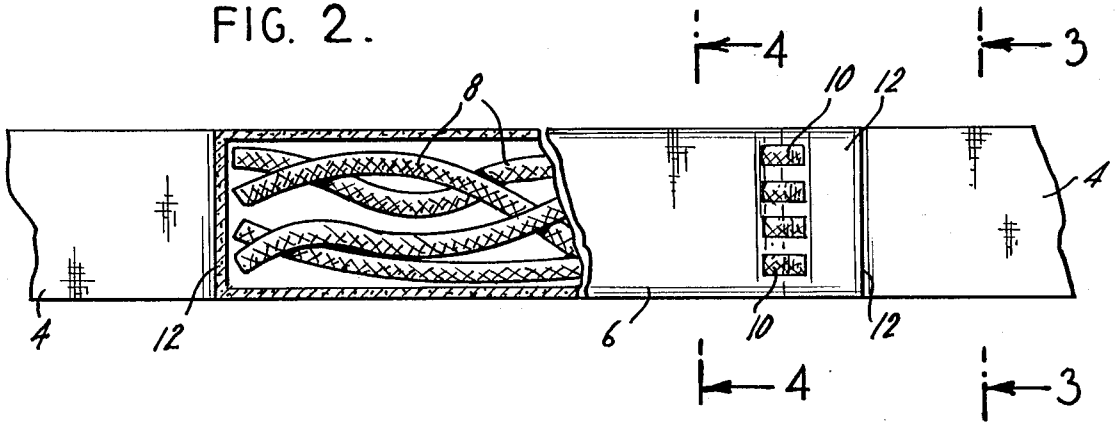
FIG. 2 is an enlarged portion of FIG. 1 partially broken away, showing braided cords inside a tubular portion.

FIG. 2 shows an enlarged area of the tubular portion 6 of FIG. 1 with part of its top surface removed in order to show the braided cords 8 within the tubular portion 6. The marginal ends 10 of the braided cords 8 near the ends 12, 12 of the tubular portion 6 are generally aligned due to the particular manufacturing process used to make the strapping 2.

As best shown in FIG. 2, in the preferred embodiment the braided cords 8 are longer than the tubular portions 6 when the strapping 2 is in its "relaxed state" or under substantially no tension. In contrast, as used herein, the "extended state" describes the strapping when it is being subjected to sufficient tension to extend such material a substantial distance in the longitudinal direction or the direction parallel to the length of the strapping.

Figure 3:
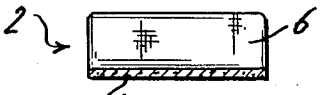
FIG. 3 is a sectional view through a flat portion of the strapping along the line 3—3 in FIG. 2, looking in the direction of the arrows.

FIG. 3 is a sectional view through the flat portion 4 of the strapping 2 along the line 3—3 in FIG. 2 looking in the direction of the arrows. FIG. 3 essentially shows an end view of the tubular portion 6 and the thickness of the cushioned tubular portion 6 relative to the flat portion 4.

Figure 4:
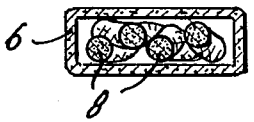
FIG. 4 is a sectional view through a tubular portion of the strapping along the lines 4—4 in FIG. 2, looking in the direction of the arrows.

FIG. 4 shows the interior of the tubular portion 6. When the strapping 2 is in its relaxed state as shown in FIG. 2, and the braided cords 8 positioned inside of the tubular portion 6 extended within the tubular portion forming a cushion.

The strapping 2 is fabricated using a machine capable of continuously weaving or knitting alternating flat and tubular portions of strapping. The flat portions 4 are constructed with the braided cords 8 outside and adjacent the strapping. The construction then switches to tubular and the tubular portion 6 is formed around the braided cords 8. No portion of the strapping need be opened to introduce or retain the braided cords 8 within the tubular portions 6. Furthermore, the tubular portions 6 do not require separate operations to close the tubular portions 6 because the transition to the fabrication of the flat portion 4 automatically closes the end portions 12 of the tubular portions 6 and causes the braided cords 8 to be outside the next flat portion.

In the preferred embodiment both the flat and tubular portions 4, 6 of the strapping 2 are fabricated from elastomeric yarns such as Lycra. During construction the elastic yarn is woven or knit while under tension. Thus, once fabricated and the tension is released the flat and tubular portions 4, 6 contract into the relaxed state and are extensible from the relaxed state to an extended state. Preferably, the braided cords 8 have an extensibility less than the fabric of the tubular portion 6. During fabrication the strapping is in the extended state and the braided cords 8 have a length substantially equal to the extended length of the tubular portions 6. When the strapping 2 is allowed to return to its relaxed state, the tubular portions 6 contract and, as a result, the braided cords 8 within the tubular portion 6 of the strapping 2 are longer than the tubular portions. Consequently, the additional braiding material in the tubular portions 6 assumes a more random orientation providing a cushioning within the tubular portion 6 as shown in FIGS. 2 and 4.

In order to prevent the braided cords 8 from bunching together or moving to one end of the tubular portion or the other, each end 10 of the braided cord 8 may be bound to the ends 12 of the tubular portion. It is also possible to bind the braided cords 8 to the tubular portion at locations intermediate the ends.

As the braided cords 8 are substantially enclosed within the tubular portions 6 and cannot be seen by a consumer it is possible to use a lower cost yarn to form the braided cords thereby providing economy in the production of the strapping 2.

Figure 7:
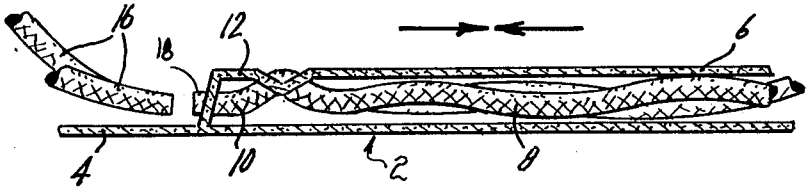
FIG. 7 is a partial elevational view, in section, showing the strapping of FIG. 6 in its relaxed state and during the removal of portions of the braided cords outside the tubular portion.

As shown in FIG. 7 the strapping 2 of the present invention is finished by removing the portion of the braided cords 16 extending beyond the ends 12 of the tubular portions 6. Thereafter, the strapping 2 is cut into straps having a central cushioned tubular portion 6 bounded at each end by flat portions 4,4. The cushioned tubular portion 6 and the flat portions 4,4 can be of any desired lengths.

A method of manufacturing the strapping 2 in accordance with the present invention will be described in connection with FIGS. 5 through 9. A conventional weaving or knitting machine is used to continuously fabricate alternating flat and tubular strapping portions. Such machines are known in the art and available commercially. For clarity the following discussion will refer to woven strapping 2.

Figure 5:
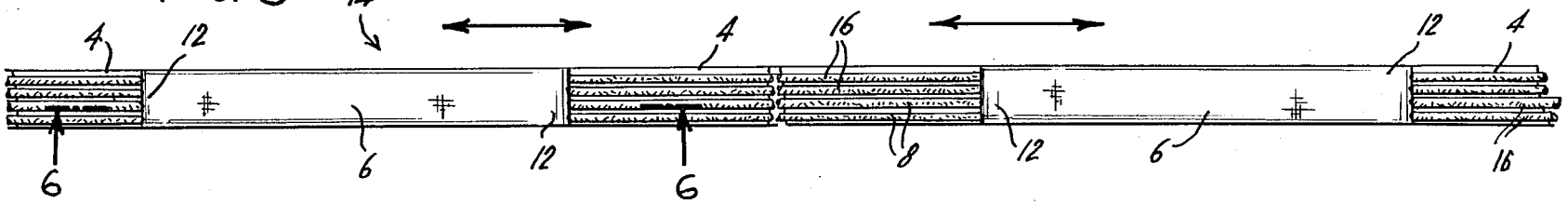
FIG. 5 is a plan view showing the strapping of FIG. 1 during its fabrication.

A conventional weaving machine (not shown) is used to first produce an intermediate strapping article 14 shown in FIG. 5. Specifically, the weaving machine first forms a flat portion. Simultaneous with the weaving operation a plurality of braided cords 8 are fed into the machine in the longitudinal direction near and above the strapping 14 while the flat portion 4 is woven so that the braided cords 8 remain independent of the flat portions 6. That is, the braided cords 8 are separated from the flat portions 4 rather than woven in. After an appropriate length of flat portion 4 is woven, the weaving machine is switched to the tubular weaving mode of operation during which the tubular portion 6 is woven around the braided cords 8 so that the woven tubular portion 6 of the strapping 14 encloses a portion of the braided cords 8 as shown in FIGS. 5 and 6.

Preferably the untrimmed strapping 14 is woven from elastic yarn such as Lycra while the yarn is under tension. As a result, the portion of the braided cords 8 enclosed in each tubular portion 6 have lengths substantially equal to the tubular portion 6 in their extended state. This condition is shown in the partial, sectional view of FIG. 6.

Next, the ends 10 of the braided cords 8 are bound to the end portions 12 of the tubular portions 6 at both ends. The binding can be accomplished by a pass of a needle or a pick through the back of the tubular portion 6 catching the cords 8 within the top surface of the tubular portion. Alternatively, the end segments 10 of the braided cords 8 may be bound by stitching or other means.

Figure 6:
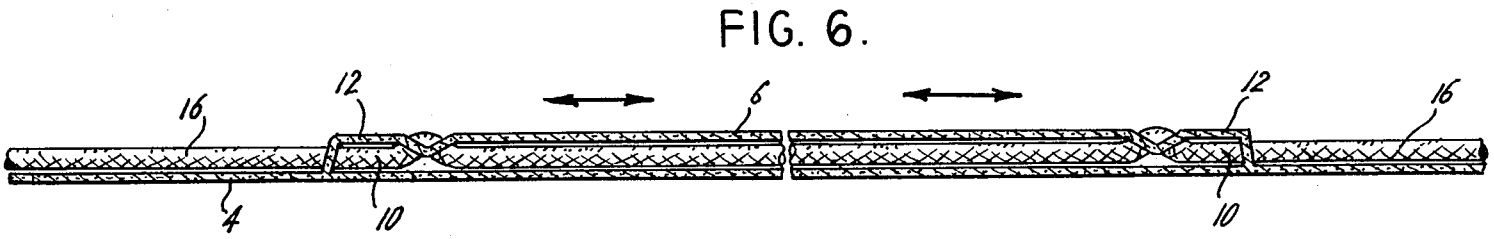
FIG. 6 is a side elevational view, in section, of the strapping of FIG. 5 in its extended state.

During fabrication, the tension is removed from the strapping 14 of FIG. 6 so the strapping is allowed to assume its relaxed state as shown in FIG. 7. When the strapping is in its relaxed state the braided cords 8 assume a non-linear path through the tubular portion 6 due to the braided cords 8 being longer than the tubular portion 6. Next, the braided cords 16 extending outside the tubular portions are removed by cutting just outside the end portion 12 of the tubular portion 6. At that point in the method of manufacture short lengths 18 of the braided cords remain outside of the tubular portion 6. Although the strapping shown in FIG. 7 is a commercially useable product and may be cut into short lengths of cushioned support strap comprising flat portions separated by a tubular portion, this product can be improved as shown in FIGS. 8 and 9.

Figure 8:
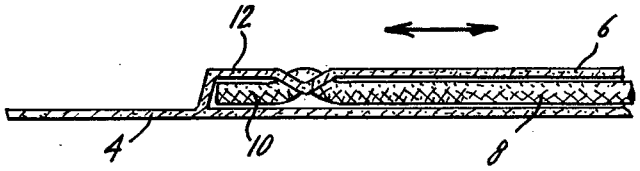
FIG. 8 shows a partial elevational view, in section, of the article of FIG. 7 which has been extended to allow the ends of the braided cords to enter the tubular portion.
Figure 9:
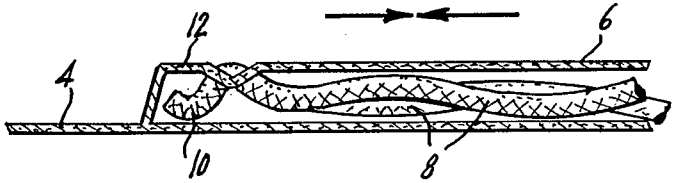
FIG. 9 is a partial elevational view, in section, of the article FIG. 8 in its relaxed state corresponding to FIG. 1.

As shown in FIG. 8, when the strapping 14 is placed under tension, the extensible tubular portion 6 is caused to extend relative to the end portions 10 of the relatively inextensible braided cord 8. Consequently, the end portions 10 are pulled entirely into the tubular portion 6 resulting in the finished appearance of the strapping 14. When the tension is released and the strapping 14 allowed to resume its relaxed state, the finished strapping has a good appearance with smooth and continuous surfaces as shown in FIG. 9 with the internal braided cords 8 providing a cushioning. Thereafter, the strapping 14 can be cut into individual lengths of cushion support strap with each cushion support strap having a cushioned center portion bounded by two flat portions.

Figure 10:
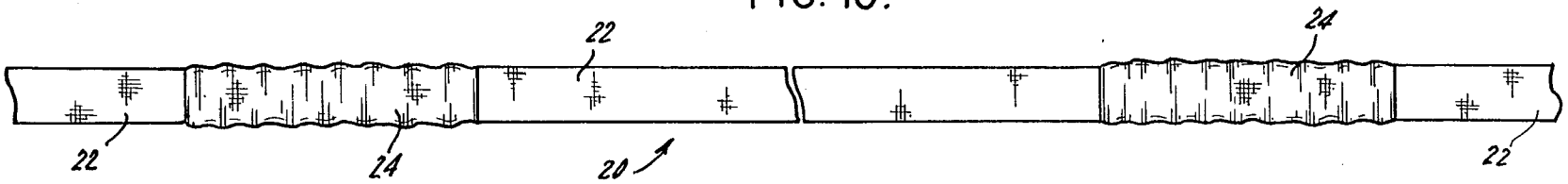
FIG. 10 is a plan view of another embodiment of the manufactured article of strapping which can be cut into individual cushioned support straps in accordance with the invention.
Figure 12:
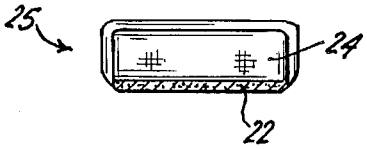
FIG. 12 is a sectional view through a flat portion along the line 12—12 in FIG. 11, looking in a direction of the arrows.

A further embodiment of the present invention is shown in FIG. 10 wherein the strapping is generally designated by the reference numeral 20 and is again constructed of flat portions 22 and tubular portions 24. In this embodiment the strapping 20 is constructed in a manner so that the strapping itself is relatively inelastic while the braided cords 26 are relatively elastic.

Figure 11:
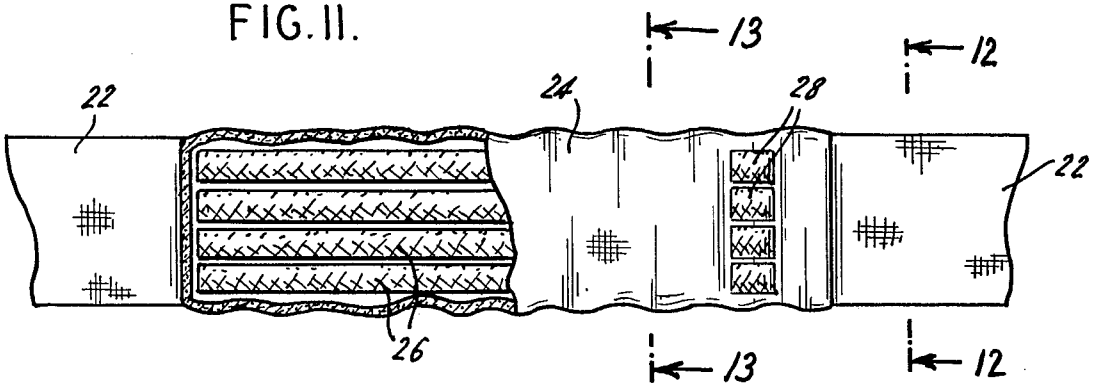
FIG. 11 is an enlarged portion of FIG. 10, partially broken away, showing braided cords inside a tubular portion.

As best shown in FIG. 11, the strapping 20 has a plurality of braided cords located inside the tubular portion 22 of the strapping 20. This alternate embodiment of the strapping is constructed in substantially the same manner as the preferred embodiment. Specifically, during formation, the tubular portion 24 of the strapping 20 is woven around the relatively elastic braided cords 26. As discussed above, the knitting occurs while the strapping and braiding are maintained under tension. The strapping itself is fabricated to be relatively inelastic so that the "extended" state and relaxed state of the braiding have substantially the same length. On the other hand, the extended state of the relatively elastic braided cords 26 is greater than the relaxed state. Before the tension is released, the braided cords 26 while still extended have their ends firmly attached at both ends of the tubular portion to the top or bottom surface of the tubular portion by such process as stitching, thermal bonding or otherwise. Thereafter, the tension is released on the strapping allowing the elastic cords 26 inside the woven portion 24 to assume their shortened, relaxed positions causing a puckering or shortening of the tubular portion 24. The cushion 25 shown in FIG.

Figure 13:
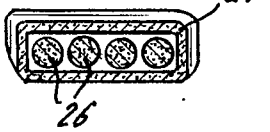
FIG. 13 is sectional view through a tubular portion of the strapping along the lines 13—13 in FIG. 11, looking in a direction of the arrows.

12 is formed by the braided cords 26 which, incident to resuming their relaxed state, will have expanded. The expansion of the braided cords 26 within the knitted, shortened tubular portion 24 is best shown in FIGS. 11 and 13. Specifically, once the elastic braided cords 26 are allowed to assume their relaxed state, the increase in the cross-sectional area of the cords substantially fills the tubular portion 24 providing the cushion 25.

Figure 14:
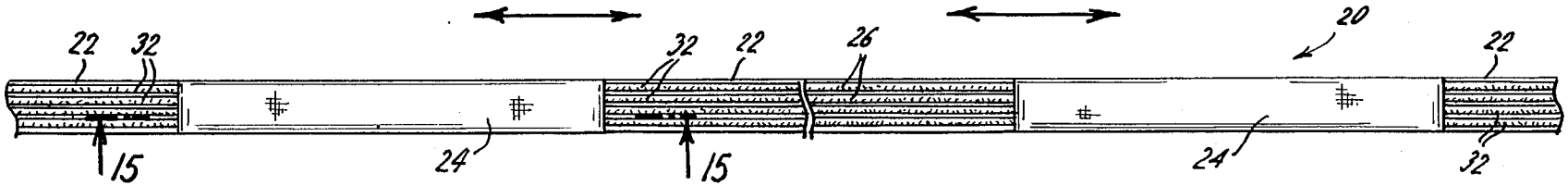
FIG. 14 is plan view showing the strapping of FIG. 10 during its fabrication.
Figure 15:
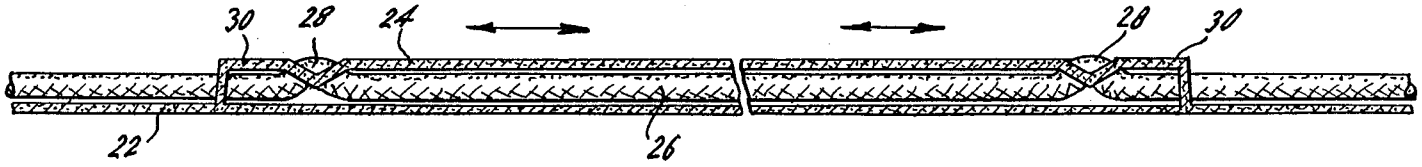
FIG. 15 is side elevational view, in section, of the strapping of FIG. 14 in its extended state.
Figure 16:
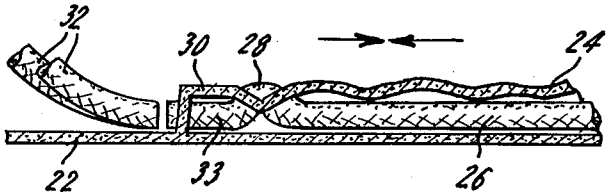
FIG. 16 is partial elevational view, in section, showing the strapping of FIG. 15 in its relaxed state and during the removal of portions of the braided cords outside the tubular portion.
Figure 17:
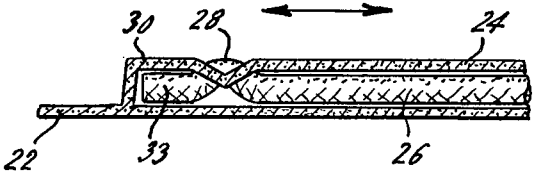
FIG. 17 shows a partial elevational view, in section, of the strapping of FIG. 16 which has been extended to allow the ends of the braided cords to enter the tubular portion.
Figure 18:
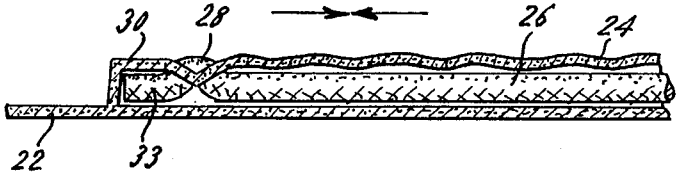
FIG. 18 is a partial elevational view, in section, of the strapping of FIG. 17 in its relaxed state and corresponds to FIG. 10.

The method of construction of the alternate embodiment of the present invention is similar to the preferred embodiment with the differences as discussed below. Specifically, as shown in FIG. 14, strapping 20 is woven with alternating flat portions 22 and tubular portions 24 of any desired length. While the flat portion is woven in a construction and from materials which are substantially inelastic, the substantially elastic braided cords 26 are outside the flat portion 24 and woven into the tubular portion 24. As shown in FIG. 15, the ends of the braided cords 26 within the tubular portion 24 are firmly fastened to the top and/or bottom surface of the tubular portion 24 by stitching 28 or other fastening means at each end 30, 30 of the tubular portion 24. During this part of the weaving operation the strapping 20 and the braided cods 26 are maintained under tension. Next, the portions 32 of the braided cords 26 extending outside the tubular portion 24 of the strapping 20 are removed by cutting or other means as best shown in FIG. 16. Subsequently, the marginal ends 33 of the braided cords 26 located between the binding 28 and the end 30 of the tubular portion 24 which are no longer under tension retract into the end 30 of the tubular portion 24 as shown in FIG. 17. When the tension on the strapping 20 is removed as shown in FIG. 18, the restorative force exerted by the actively elastic cords 26 causes the tubular portion 24 of the strapping 20 to become shortened or puckered while the braided cords 26 assume a contracted, relaxed position with the cross-sections of the relaxed cords 26 expanding to substantially fill the shortened tubular portion 24 providing a cushioning. Since the marginal ends 33 of the braided cords 26 are now totally within the tubular portion 24 of the strapping, the strapping exhibits a smooth, finished appearance.

By varying the elasticity of the braided cords 26 relative to the inelastic construction of the tubular portion 24 of strapping 20, it is possible to vary the degree of shortening and/or puckering of the tubular portion and, correspondingly, the degree of extensibility of the finished strapping.

The strapping thus formed is subsequently cut into individual lengths of cushioned support straps having a central cushioned area surrounded by flat portions.

A still further embodiment of the present invention is formed by using materials and a construction of both the tubular portion of the strapping and the braided cords to provide either substantially inelastic construction of both components or substantially equal elasticity. In such embodiment, an integral cushion is formed whereby the cushioning is provided by the bulk of the braided cords within the tubular portion.

In such embodiment, the braided cords are merely woven into the tubular portion of the strapping during formation of the strapping as discussed above. Upon completion of the construction of the strapping as tension is released, because the tubular portion and the braided cords have substantially the same degree of elasticity, as the tubular portion is allowed to assume its relaxed state, the braided cords likewise assume their relaxed state. In the relaxed state, the braided cords have a length substantially equal to the length of the tubular portion of the strapping. In such construction, the cushioning effect results from the diameter of the braided cords inside the tubular portion and the orientation of the cords within such portion will be substantially as shown in FIG. 11 while the outer surface of the tubular portion will be substantially smooth as shown in FIG. 2.

When large diameter cords are used, a greater cushioning effect results and a cross-section through the tubular portion will look substantially like the cross-section shown in FIG. 13.

When relatively non-elastic yarns and constructions are used to produce both the strapping and the braided cords, it is not necessary to construct the strapping using any degree of excess tension. Consequently, an integral cushioned tubular portion results without regard to whether the strapping is elastic in the longitudinal direction or not.

As in the other embodiments discussed above, once the strapping is formed with alternating flat sections and cushioned tubular sections, individual support straps are formed by cutting the strapping into discrete sections including a cushioned tubular portion surrounded by flat portions.

A latitude of modification, change and substitution is intended in the foregoing disclosure and, in some instances, some features of the invention will be employed without a corresponding use of other features. Accordingly, it is appropriate that the appended claims be construed broadly and in a matter consistent with the spirit and scope of the invention.

What is claimed is:

1. An article of manufacture for producing cushioned straps, comprising a continuously woven fabric having flat and tubular portions, and a plurality of lengths of yarn positioned in each of the tubular portions and extending through each of the tubular portions between the end portions thereof.

2. The article of claim 1, which is extensible longitudinally between an extended state and a relaxed state wherein the lengths of yarn in each tubular portion are longer than the respective tubular portion.

3. The article of claim 1, wherein the lengths of yarn in each tubular portion are substantially the same as the length of the respective tubular portion when the article is in its relaxed state.

4. The article of claim 1, wherein the lengths of yarn are non-elastic.

5. The article of claim 1, wherein the lengths of yarn are elastic.

6. The article of claim 1, wherein said fabric is produced from elastomeric yarn.

7. The article of claim 1, wherein the lengths of yarn in each tubular portion are substantially entirely within the respective tubular portion.

8. An article of manufacturing for producing cushioned support straps, comprising a continuously woven fabric having alternate flat and tubular portions; a plurality of lengths of yarn positioned in each of the tubular portions extending substantially freely through each of the tubular portions between the end portions thereof; and binding means near the end portions of each tubular portion for binding the ends of the lengths of yarn to the respective tubular portion, the lengths of yarn in the respective tubular portion being shorter than the respective tubular portion when the article is in its relaxed state.

9. The article of claim 8, wherein the lengths of yarn are elastic.

10. The article of claim 8, wherein the lengths of yarn in the respective tubular portion are substantially entirely within the respective tubular portion.

11. A cushioned strap, comprising a continuously woven fabric having two flat portions separated by a tubular portion; and a plurality of lengths of yarn positioned in the tubular portion and extending through the tubular portion between the end portions thereof.

12. The strap of claim 11 which is extensible longitudinally between an extended state and a relaxed state, wherein the lengths of yarn in the tubular portion are longer than the tubular portion.

13. The strap of claim 11, wherein the lengths of yarn in the tubular portion are substantially the same length as the respective tubular portion.

14. The strap of claim 11, wherein the lengths of yarn are non-elastic.

15. The strap of claim 11, wherein the lengths of yarn are elastic.

16. The strap of claim 11, wherein said fabric is produced from elastomeric yarn.

17. The strap of claim 11, wherein the lengths of yarn in said tubular portion are substantially entirely within said tubular portion and extend substantially freely through the tubular portions between the ends thereof.

18. A cushioned strap, comprising a continuously woven fabric having two flat portions separated by a tubular portion; a plurality of lengths of yarn positioned in the tubular portion and extending substantially freely through the tubular portion between the end portions thereof; and binding means near the end portions of the tubular portion for binding the ends of the lengths of yarn to the tubular portion, the lengths of yarn being shorter than the tubular portion when the strap is in its relaxed state.

19. The strap of claim 18, wherein the lengths of yarn are elastic.

20. The strap of claim 18, wherein the lengths of yarn and the tubular portions are substantially entirely within that tubular portion.

21. An article of manufacture for producing cushioned straps, comprising a continuously knitted fabric having flat and tubular portions, and a plurality of lengths of yarn positioned in each of the tubular portions and extending through each of the tubular portions between the end portions thereof.

22. The article of claim 21, which is extensible longitudinally between an extended state and a relaxed state wherein the lengths of yarn in each tubular portion are longer than the respective tubular portion.

23. An article of manufacturing for producing cushioned support straps, comprising a continuously knitted fabric having alternate flat and tubular portions; a plurality of lengths of yarn positioned in each of the tubular portions extending substantially freely through each of the tubular portions between the end portions thereof; and binding means near the end portions of each tubular portion for binding the ends of the lengths of yarn to the respective tubular portion, the lengths of yarn in the respective tubular portion being shorter than the respective tubular portion when the article is in its relaxed state.

24. A cushioned strap, comprising a continuously knitted fabric having two flat portions separated by a tubular portion; and a plurality of lengths of yarn positioned in the tubular portion and extending through the tubular portion between the end portions thereof.

25. The strap of claim 24 wherein the lengths of yarn in said tubular portion are substantially entirely within said tubular portion and extended substantially freely through the tubular portions between the ends thereof.

26. A cushioned strap, comprising a continuously knit fabric having two flat portions separated by a tubular portion; a plurality of lengths of yarn positioned in the tubular portion and extending substantially freely through the tubular portion between the end portions thereof; and binding means near the end portions of the tubular portion for binding the ends of the lengths of yarn to the tubular portion, the lengths of yarn being shorter than the tubular portion when the strap is in its relaxed state.

* * * * *